US006488489B2

(12) United States Patent
Williams et al.

(10) Patent No.: US 6,488,489 B2
(45) Date of Patent: Dec. 3, 2002

(54) METHOD OF ALIGNING SCROLL COMPRESSOR COMPONENTS

(75) Inventors: John R. Williams; Joe T. Hill, both of Bristol, VA (US); Gene M. Fields, Arkadelphia, AR (US); Tracy Milliff, Bristol, VA (US); Michael R. Young, Wichita, KS (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/793,369

(22) Filed: Feb. 26, 2001

(65) Prior Publication Data

US 2002/0119061 A1 Aug. 29, 2002

(51) Int. Cl.[7] ..... F04C 18/04; F04C 29/00

(52) U.S. Cl. ..... 418/55.1; 29/888.022; 384/276; 384/295

(58) Field of Search ..... 418/55.1; 29/462, 29/525, 888.022; 384/276, 295

(56) References Cited

U.S. PATENT DOCUMENTS 5,188,520 A * 2/1993 Nakamura et al. ..... 29/888.022

5,564,186 A * 10/1996 Hori et al. ..... 29/888.022

FOREIGN PATENT DOCUMENTS

| | | | | |
|---|---|---|---|---|
| JP | 59-28088 | * | 2/1984 | ..... 418/55.1 |
| JP | 61-8487 | * | 1/1986 | ..... 418/55.1 |
| JP | 61-250393 | * | 11/1986 | ..... 418/55.1 |
| JP | 4-166688 | * | 6/1992 | ..... 418/55.1 |

* cited by examiner

*Primary Examiner*—John J. Vrablik
(74) *Attorney, Agent, or Firm*—Carlson, Gaskey & Olds

(57) ABSTRACT

An improved method of aligning the bearing components within a scroll compressor includes the step of mounting the crankcase to be an interference fit within the center shell, and having a surface abutting a true upper surface of the shell. This ensures that the axis of the bearing in the crankcase is idealized and centered on the center axis of the center shell. At the same time, the lower bearing is mounted on the lower end cap, and is also cut to be concentric with a force fit outer surface of the end cap. This ensures the lower bearing is also centered on the inner periphery of the center shell. Once it is ensured the center shell is true, then it is also thus ensured the upper and lower bearings are aligned on a common axis. An improved lower bearing structure with a reverse taper is also disclosed.

6 Claims, 3 Drawing Sheets

Fig-4C
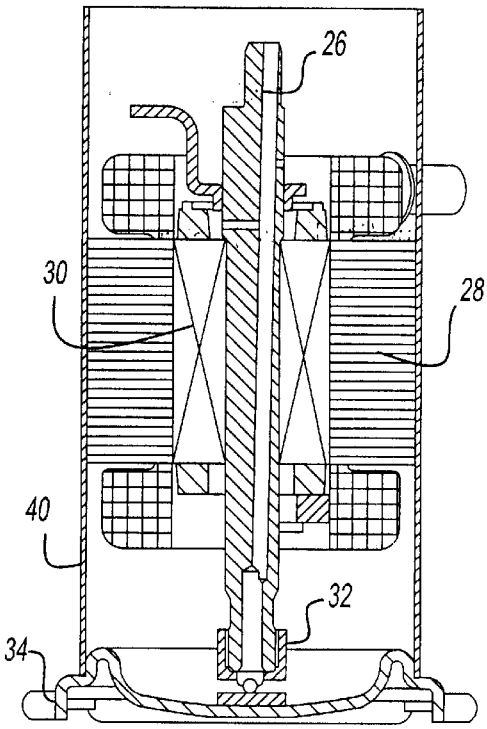
Fig-4D
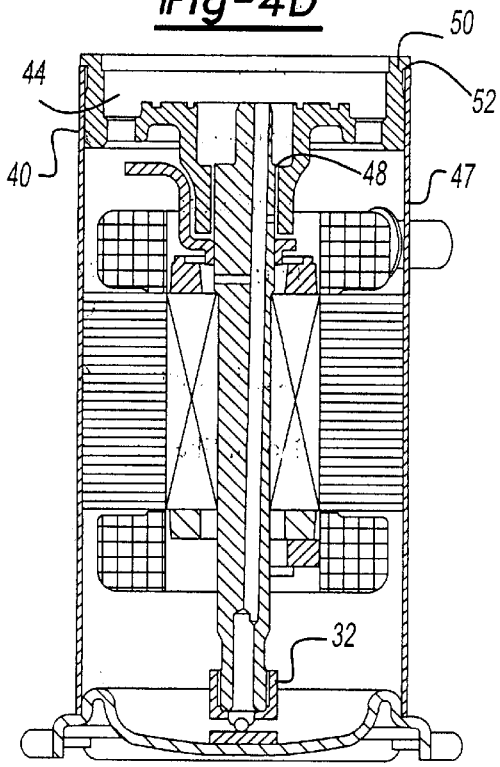
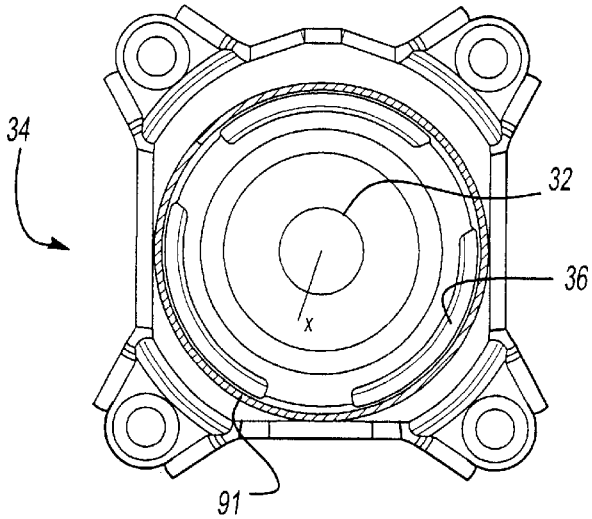
Fig-5A
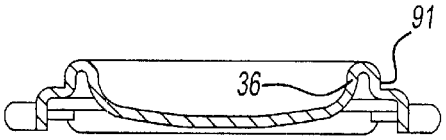
Fig-5B
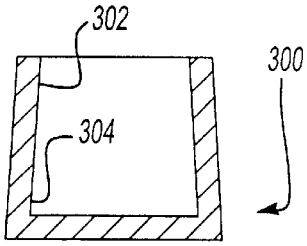
Fig-6
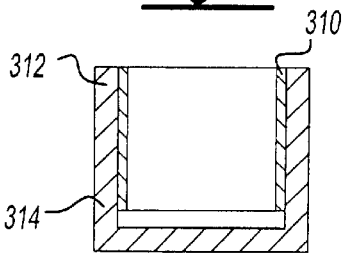
Fig-7

METHOD OF ALIGNING SCROLL COMPRESSOR COMPONENTS

BACKGROUND OF THE INVENTION

This invention relates to a method wherein the components adjacent the top and bottom of a scroll compressor are all aligned with regard to a common reference such that total alignment of the components can be more easily and accurately achieved.

Scroll compressors are becoming widely utilized in refrigerant compression applications. In a scroll compressor, first and second scroll members each include a base and a generally spiral wrap extending from the base. The wraps interfit to define compression chambers. A shaft is operably connected to one of the scroll members to cause that scroll member to orbit relative to the other. As the two scroll members orbit, compression chambers defined between the wraps of the two scroll members decrease in volume, compressing an entrapped refrigerant.

Historically, scroll compressors are mounted in a sealed housing. The housing includes a center shell and upper and lower end caps. The shaft which drives the orbiting scroll member is typically driven by an electric motor mounted within the center shell. The shaft extends along a rotational axis, and is operably connected to the orbiting scroll to cause orbiting movement of the orbiting scroll. Typically, the shaft is mounted in bearings adjacent upper and lower positions. The upper bearing is mounted within a crankcase, which supports the orbiting scroll member. The lower bearing is typically on an opposed side of the motor from the scroll members. Historically, a bearing support has extended radially inwardly from the center shell to support the lower end of the bearing.

More recently it has been proposed to mount the lower bearing in the scroll compressor on the lower end cap. Thus, in prior U.S. patent application Ser. No. 09/376,915, filed Aug. 18, 1999, and entitled "BEARING ASSEMBLY FOR SEALED COMPRESSOR", and further in a co-pending application entitled "LOWER END CAP FOR SCROLL COMPRESSOR" filed on Jun. 1, 2001 and assigned Ser. No. 09/872,972, lower end cap structure for mounting a bearing has been disclosed.

Further, it has recently been proposed to force fit the crankcase into the center shell such that the position of the crankcase is ideally located relative to the center shell. Such structure has been disclosed in co-pending application Ser. No. 09/176,576, filed Oct. 21, 1998 and entitled "FORCE-FIT SCROLL COMPRESSOR ASSEMBLY" and now assigned U.S. Pat. No, 6,193,484.

However, the two ideas have never been proposed to be combined.

SUMMARY OF THE INVENTION

In the disclosed embodiment of this invention, the center shell is utilized as a point of reference to ideally position the lower bearing through the mount of a lower end cap, and the crankcase both at a location ideally determined and positioned by the common reference. In a preferred embodiment, the common reference is provided by the center shell. The center shell is machined to have carefully controlled end surfaces that are both perpendicular to the center axis of the center shell, and which are ideally close to being cylindrical. The initial shell formation can be slightly out of round (i.e., on the order of 1.0 mm), as it will be brought to complete roundness by the computer cut surfaces of both the crankcase and the lower end cap, and as will be explained below.

The lower end cap is machined such that it has mount surfaces which are both perpendicular to the lower bearing bore and a set radial spacing away from the axis of the lower bearing. When this lower end cap is mounted within this center shell, the bearing is thus ideally located relative to the center axis of the center shell.

Further, the crankcase is machined to have an idealized outer cylindrical surface, and a flat end face which abuts the end face of the center shell. When this crankcase is mounted in this center shell along with the lower end cap, it is assured that the crankcase and the lower end cap are both mounted at a proper orientation relative to each other. Since both the end cap and the crankcase are separately machined on their own to ensure that the axis of the bearing for the shaft that they each carry are true to the outer periphery of the individual component, it is also ensured that the two bearings are thus ideally located relative to each other. Once these two bearing mounts for the shaft are ideally determined, the other components of the scroll compressor come together easily and at assured aligned position.

Thus, the present invention provides a simplified method of ideally locating components within a scroll compressor such that it is assured they are properly located.

These and other features of the present invention can be best understood from the following specification and drawings, the following of which is a brief description.

BRIEF DESCRIPTION OF THE DRAWINGS

FIG. 4C shows yet another step.

FIG. 4D shows yet another step.

FIG. 5A is a top view of an end cap.

FIG. 5B shows an enlarged portion of one location on the FIG. 5A end cap.

FIG. 6 shows another feature of an inventive bearing.

FIG. 7 shows a feature of the FIG. 6 embodiment.

DETAILED DESCRIPTION OF A PREFERRED EMBODIMENT

Figure 1:
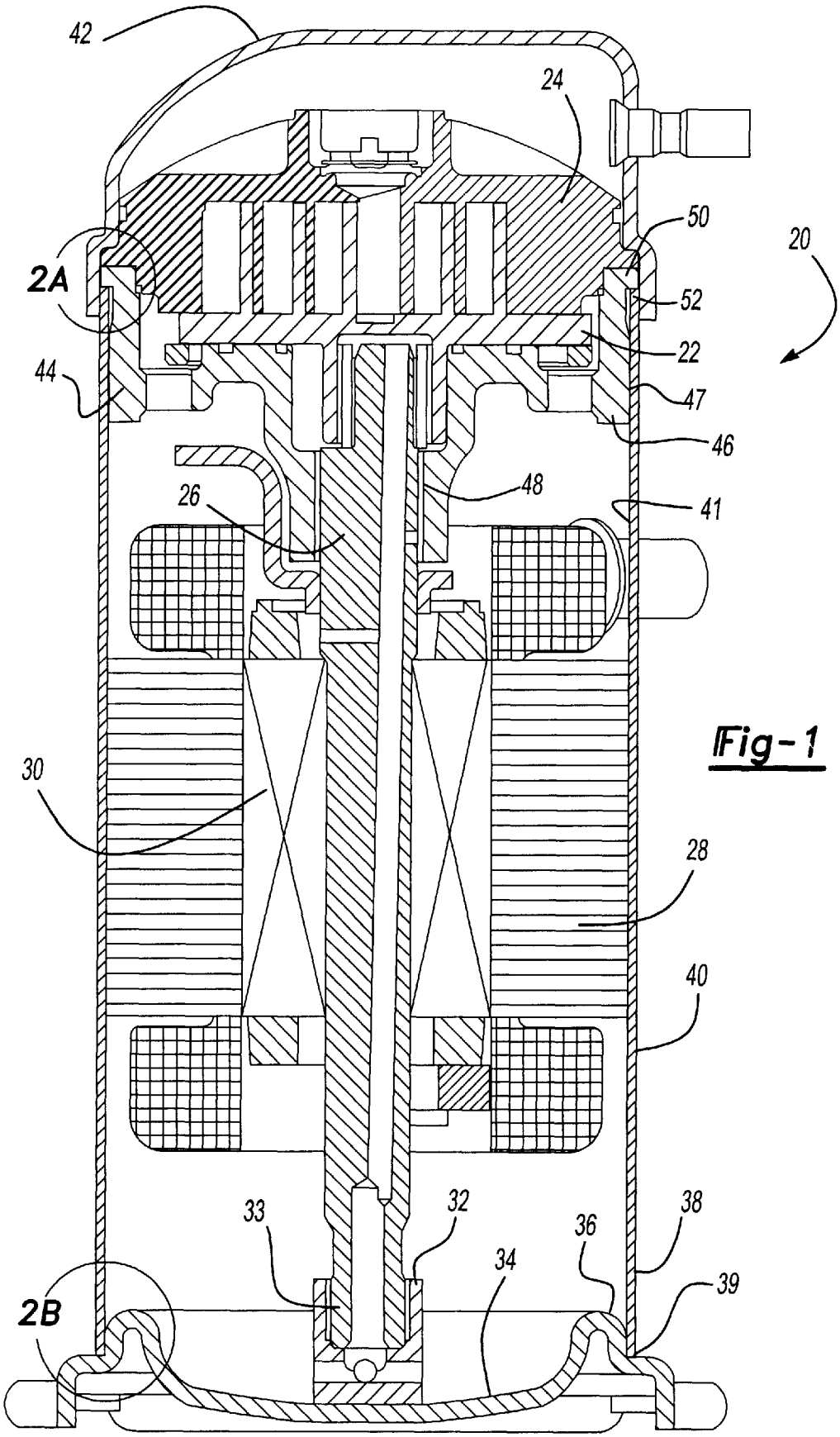
FIG. 1 is a cross-sectional view through the inventive scroll compressor.

FIG. 1 illustrates a scroll compressor 20 incorporating an orbiting scroll 22 and a non-orbiting scroll 24. A driveshaft 26 is driven by a motor stator 28 through rotor 30. The driveshaft is operatively connected to cause orbiting movement of the orbiting scroll 22. The lower bearing 32 is mounted on an end cap 34. A lower end 33 of the shaft 26 engages the lower bearing 32. The end cap 34 has circumferentially spaced u-shaped portions 36 positioned radially inward of a lower end 38 of a center shell 40. The lower end 38 of the center shell 40 has an axial end surface 39 which abuts a surface on the lower shell 34, as will be explained below.

An inner periphery 41 of the center shell is formed to be close to an idealized cylinder to facilitate alignment, as will be explained below. An upper end cap 42 is secured to the center shell 40. A crankcase 44 supports the orbiting scroll 22, as known. An outer peripheral portion 46 of the crankcase 44 has an outer surface 47 which is force fit within the center shell 40.

A bearing 48 is mounted within the crankcase 44 and supports an upper end of the shaft 26. A radially outwardly extending lip 50 of the crankcase 44 abuts an end 52 of the housing 40. As will be explained below, the combination of the force fit crankcase and the bearing mounted on the lower end plate provides assurance that the bearings 32 and 48 are located on an axis which is common by setting both bearings based upon a common reference.

Figure 2A:
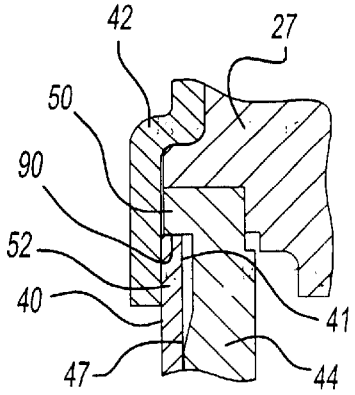
FIG. 2A is an enlarged view of circle portion 2A from FIG. 1.
Figure 2B:
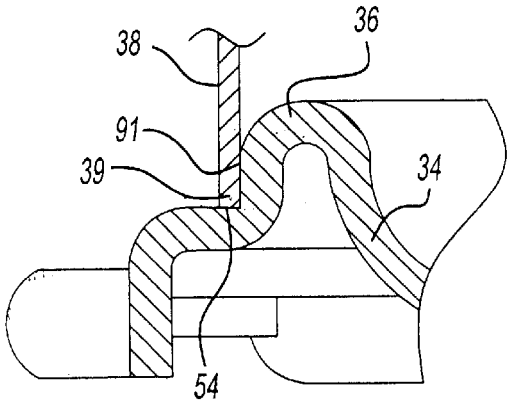
FIG. 2B is an enlarged view of circle portion 2B from FIG. 1.

As shown in FIG. 2A, the crankcase 44 has its outer periphery 47 force fit within the inner periphery 41 of the center shell 40. The radially outwardly extending flange 50 abuts the end face 52.

The downwardly facing surface 90 of the flange 50 is machined to be perpendicular to the center axis of the crankcase 47. Moreover, the outer periphery 47 of the crankcase 44 is also machined to be concentric with the bearing mount 48. Thus, by known computer control methods, Applicant ensures that the bore for the bearing 48 is concentric and ideally centered with the outer surface 47 and perpendicular to flange surface 90. It should be understood that the surface 47 may have some discontinuities, however, it is generally cylindrical, and concentric with the center axis of the bearing 48. Details of the preferred crankcase can be determined from U.S. Pat. No. 6,193,484.

Now, when the crankcase is mounted within the center shell 40 as is shown in FIG. 2A, due to the surface 90 abutting surface 52, and due to the force fit 47, one can be assured that the center axis of the bearing 48 is parallel and concentric with the interior axis of the center shell 40.

At the same time, a similar end face 54 is formed on the lower end plate 34. The axial end 39 of the lower end 38 of the center shell housing abuts the surface 54. As with the crankcase, this ensures that the lower end cap 34 is properly orientated within the center shell 40. Moreover, the outer periphery 91 of the portions 36 are sized to provide at least a slight force fit within the center shell 40. Again, this ensures that the orientation of the lower end cap 34 within the center shell 40 is idealized and true.

The center axis of the bearing 32 is preferably cut, as will be explained below, such that it is concentric with the outer periphery of the sections 36 and perpendicular to surface 39. This ensures that the bearing axis for bearing 32 is also based upon the center axis of the inner periphery 41 of the center shell 40. By utilizing these two techniques, applicant thus ensures the bearing 48 is centered on and parallel to an axis which is determined based upon the same point of reference as the axis for the bearing 32. Applicant thus ensures the bearings are more likely aligned than has been the case in the prior art.

Figure 3:
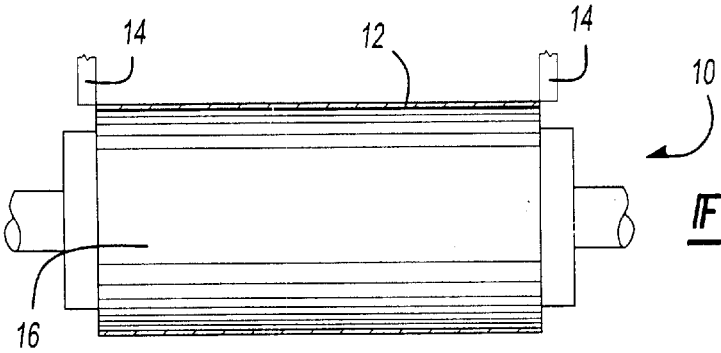
FIG. 3 schematically shows the formation of a shell component.
Figure 4A:
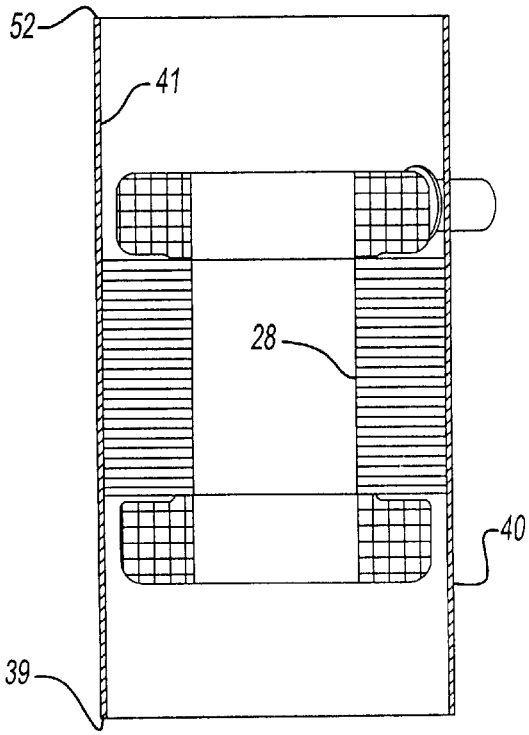
FIG. 4A shows the first step in assembly.

FIG. 3 shows a machining operation 10 highly schematically. A shell preform 12 which becomes center shell 40 is initially formed into a generally cylindrical shell by rolling a portion of steel and then welding that steel into the perform and expanding from the inner diameter. An expanding mandrel 16 extends into the inner periphery of the shell 12 and ensures the inner periphery turns between centers of the lathe. The mandrel then brings the shell 12 to a pair of opposed machining lathes 14 which cut the end surfaces on the center shell. The operation for machining the shell is as known, and is within the skill of a worker in this art. The shell preform is thus formed into the center shell 40, and as shown in FIG. 4A, the end surfaces 39 and 52 both define flat surfaces which are computer controlled to be quite close to being true flat parallel planes perpendicular to inner axis. Moreover, the inner periphery 41 is extremely close to being a true cylindrical bore. As mentioned above, the inner periphery 41 can be slightly out of round at this point, as the crankcase and lower end cap surfaces will bring it to being true once inserted.

In a first step of assembling the scroll compressor, the stator 28 is initially placed within the center shell, as shown in FIG. 4A. The center shell may be heated to receive the stator, and then may then cool to secure itself onto the stator. Moreover, electrical connections are preferably made during the mounting of the stator, and as disclosed in co-pending U.S. patent application Ser. No. 09/415,122, filed on Oct. 8, 1999 and entitled "DEFORMED COMPRESSOR MOTOR WINDING TO ACCOMMODATE COMPONENTS".

Figure 4B:
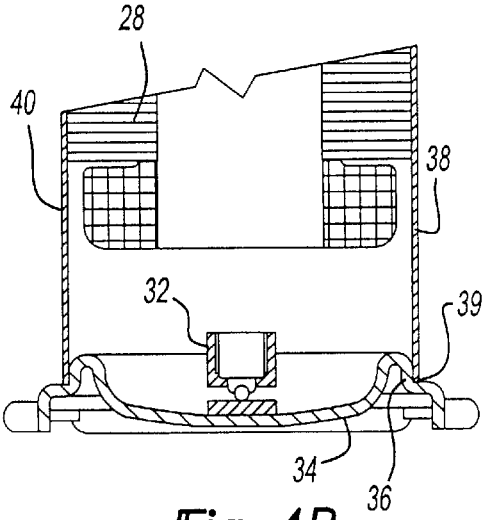
FIG. 4B shows a subsequent step.

As shown in FIG. 4B, the next step is to then force the center shell 40 downwardly onto the lower end cap 34. As described above, the lower end 38 of the center shell 40 provides a force fit onto the portions 36, such that at this point the bearing 32 has its center axis ideally centered relative to the center axis of the housing shell 40. At this time, the center shell may be tack welded to the lower end cap 34 to secure the two together for subsequent processing until final girth weld.

The next step is to mount the rotor 30 and shaft 26 within the bearing 32 and within the stator 28, as shown in FIG. 4C.

The next step is to force the crankcase 44 into the center shell 40. With this forced movement, the flange 50 is brought against the end 52. At this point, and since the bearing bore 48 has been previously cut to be a true concentric bore relative to the outer periphery 47 of the crankcase 44, it can be ensured that the bearings 48 and 32 are both centered on an axis cut relative to a common reference, the center axis of the center shell 40.

The components of the orbiting scroll and the non-orbiting scroll, including all the anti-rotation couplings, seals, etc., as are known are then placed within the compressor. The end cap 42 is then brought downwardly and the components are forced together and the upper end cap is tack welded. At that point, the end caps are welded to the center shell, securing the entire assembly.

FIG. 5A shows the lower end cap 34, with the bearing 32. As can be appreciated, the u-shaped surfaces 36 are circumferentially spaced. The outer periphery 91 of these components is cut such that this outer periphery is true and concentric to the central axis X of the bearing 32. As is explained in greater detail in co-pending U.S. patent application Ser. No. 09/376,915, filed Aug. 18, 1999 and entitled "BEARING ASSEMBLY FOR SEALED COMPRESSOR" this is ensured by cutting the center X of the bearing to be concentric with the outer surface 91 of the portions 39. FIG. 5B shows another view of the outer surface 91 in the portion 36.

In sum, by ensuring the centers of the bearings 32 and 48 are both cut and measured by computer controlled equipment to be concentric with a common reference Applicant ensures the two bearings are ideally located and aligned relative to each other. The present invention thus improves greatly upon the prior art.

FIG. 6 shows a bearing embodiment 300 wherein the bearing hub has an upper end 302 which is tapered laterally inwardly from a lower end 304. When the bearing body 310, as shown in FIG. 7, is inserted, the upper end is bent back as shown at 312 relative to the lower end 314. The bearing body 310 is cylindrical, as shown. In the prior art, when the bearing was inserted, it bent the unsupported upper end radially outwardly, and resulted in the free end of the hub being bent outwardly, rather than being a cylindrical surface. Thus, this reverse tapering provides benefits. free end of the hub being bent outwardly, rather than being a cylindrical surface. Thus, this reverse tapering provides benefits.

Essentially, the computer cut concentric outer peripheral surfaces on the crankcase and the lower end cap ensure that the bearing bores are each equally spaced radially from the inner periphery of the center shell. At the same time, the flat surfaces ensure that the crankcase and lower end cap will be parallel to each other, such that the axes of their bearing bores will be concentric and parallel also.

Although a preferred embodiment of this invention has been disclosed, a worker in this art would recognize that modifications may come within the scope of this invention. For that reason the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, a shaft for driving said second scroll member to orbit relative to said first scroll member;

a crankcase for supporting said second scroll member, said crankcase having an outer peripheral surface of a predetermined outer diameter, said outer peripheral surface of said crankcase being machined to be concentric with a bearing bore found at a central axis of said crankcase, said bearing bore receiving an upper bearing;

a housing enclosing said shaft and said first and second scroll members and said crankcase, said housing including a center shell and upper and lower end caps;

said lower end cap mounting a lower bearing for supporting a lower end of said shaft and said bearing bore in said crankcase mounting an upper bearing for supporting an upper end of said shaft;

said lower bearing having a bearing axis which is cut to be concentric and parallel relative to an outer peripheral surface on said lower end cap, and said outer peripheral surface of said lower end cap being concentric with an inner peripheral surface of said center shell, and said outer peripheral surface of said crankcase being concentric with said inner peripheral surface of said center shell such that said upper and lower bearings are concentric with regard to each other.

2. A scroll compressor as recited in claim 1, wherein said center shell has upper and lower axial ends which are cut to be parallel to each other, and said crankcase having a radially outwardly extending flange which abuts said upper end of said center shell and is cut to be perpendicular to said axis of said upper bearing such that said crankcase is properly aligned within said center shell, and said lower end cap having a surface which is cut to be perpendicular to said rotational axis of said bearing such that said lower end cap is properly mounted within said center shell, and such that said axes of said upper and lower bearings are aligned.

3. A scroll compressor as recited in claim 1, wherein said lower bearing is initially formed to have a reverse taper such that insertion of said shaft into said lower bearing causes said reverse taper to move more towards a cylindrical surface.

4. A scroll compressor comprising:

a first scroll member having a base and a generally spiral wrap extending from said base;

a second scroll member having a base and a generally spiral wrap extending from its base, a shaft for driving said second scroll member to orbit relative to said first scroll member;

a housing enclosing said shaft and said first and second scroll members and a crankcase, said housing including a center shell and upper and lower end caps;

said lower end cap mounting a lower bearing for supporting a lower end of said shaft and a bearing bore in said crankcase mounting an upper bearing for supporting an upper end of said shaft;

said lower end cap mounting a bearing through a bearing hub, said bearing hub having an axially upper end which is tapered inwardly towards a central axis of said hub from an axially lower end, and a cylindrical bearing forced into said hub such that said upper end of said hub is bent back towards a more cylindrical surface with said lower end of said hub.

5. A method of assembling a scroll compressor comprising the steps of:

1) providing a center shell having a pair of opposed axial ends, said axial ends being cut to be parallel to each other, forming a crankcase having an outer peripheral surface which is generally cylindrical and centered on an axis, and provides a tight fit within a cylindrical inner surface of said center shell, said crankcase having a radially outwardly extending surface for abutting said axial end of said center shell, providing a lower end cap having an outer peripheral surface, sized to be a close fit within said cylindrical inner surface of said center shell, and said lower end cap having a face formed to be perpendicular to a central axis of a lower bearing mounted on said lower end cap; and 2) mounting said crankcase within said center shell and mounting said lower end cap within said center shell such that said axes of said crankcase and lower bearings are both concentric to a common point of reference.

6. A method as recited in claim 5, wherein both said crankcase and said lower end cap are formed to have a surface perpendicular to an end surface of said center shell, such that when said crankcase and said lower end cap are mounted within said center shell, said crankcase and said lower end cap will both have said surfaces be parallel to each other, said crankcase having a bearing bore centered on an axis for receiving an upper bearing and such that said axes of the bearing bores formed in said crankcase and said lower end cap will be concentric and parallel.

* * * * *